US008833357B2

(12) United States Patent
Werder et al.

(10) Patent No.: US 8,833,357 B2
(45) Date of Patent: Sep. 16, 2014

(54) DEVICE FOR ADJUSTING THE BLADE GUARD HOLDER OF A WALL SAW

(75) Inventors: Bruno Werder, Gamprin (LI); Josef Schittl, Thueringen (AT); Walter Nessler, Ludesch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 12/802,180

(22) Filed: Jun. 1, 2010

(65) Prior Publication Data

US 2011/0203564 A1 Aug. 25, 2011

(30) Foreign Application Priority Data

Jun. 2, 2009 (DE) ..... 10 2009 026 638

(51) Int. Cl.
*B28D 1/04* (2006.01)

(52) U.S. Cl.
CPC ..... *B28D 1/045* (2013.01); *B28D 1/044* (2013.01)
USPC ..... 125/13.01; 125/14

(58) Field of Classification Search
USPC ..... 125/13.01, 14; 451/452; 83/478, 879, 83/881, 886, 887, 574; 299/39.1, 39.6, 299/39.3
See application file for complete search history.

(56) References Cited

U.S. PATENT DOCUMENTS 3,722,497 A * 3/1973 Hiestand et al. ..... 125/14
3,763,845 A * 10/1973 Hiestand et al. ..... 125/14
3,914,905 A * 10/1975 Waters ..... 451/358
4,134,459 A * 1/1979 Hotchen ..... 173/32
4,294,148 A * 10/1981 Drixler ..... 83/397
4,672,746 A * 6/1987 Zeilenga ..... 30/391
4,848,001 A * 7/1989 Clark et al. ..... 30/391
4,885,966 A * 12/1989 Johnsen ..... 83/397
4,979,412 A * 12/1990 Anders ..... 83/397
5,103,704 A * 4/1992 Spath et al. ..... 83/452
5,140,754 A * 8/1992 Martenson ..... 30/390
5,146,825 A * 9/1992 Dehari ..... 83/397
5,287,779 A * 2/1994 Metzger, Jr. ..... 83/102.1
5,513,548 A * 5/1996 Garuglieri ..... 83/397
5,564,408 A * 10/1996 Bassols ..... 125/12
5,579,753 A * 12/1996 Chiuminatta et al. ..... 125/12
5,588,418 A * 12/1996 Holmes et al. ..... 125/13.01
5,787,779 A * 8/1998 Garuglieri ..... 83/397
5,810,448 A * 9/1998 Kingsley et al. ..... 299/39.3
5,832,614 A * 11/1998 Gallagher et al. ..... 30/391
5,887,579 A * 3/1999 Eriksson et al. ..... 125/14
5,921,228 A * 7/1999 Watson ..... 125/13.01
6,170,478 B1 * 1/2001 Gorder ..... 125/12
6,648,742 B1 * 11/2003 Segiel, Jr. ..... 451/451
6,971,297 B1 * 12/2005 Meredith et al. ..... 83/478
7,018,279 B2 * 3/2006 Baratta ..... 451/344
7,353,737 B2 * 4/2008 Gass et al. ..... 83/62.1

(Continued)

FOREIGN PATENT DOCUMENTS

DE 196 01 522 7/1997
FR 2 624 049 A1 6/1989

*Primary Examiner* — Joseph J Hail
*Assistant Examiner* — Marc Carlson
(74) *Attorney, Agent, or Firm* — Davidson, Davidson & Kappel, LLC

(57) ABSTRACT

A device (20) for adjusting the blade guard holder (17) arranged on the saw arm (3) of a wall saw (1), having a coupling element (25) is provided, whereby a first end of the coupling element (25) is joined to the blade guard holder (17), and, in a locked state, a second end is joined to the saw arm (3).

15 Claims, 3 Drawing Sheets

(56) References Cited

U.S. PATENT DOCUMENTS

| | | | | |
|---|---|---|---|---|
| 7,814,818 | B2 * | 10/2010 | Domeny et al. | 83/102.1 |
| 8,079,295 | B2 * | 12/2011 | Gass | 83/478 |
| 8,096,220 | B2 * | 1/2012 | Weir et al. | 83/478 |
| 2003/0172917 | A1 * | 9/2003 | Baratta | 125/13.01 |
| 2006/0169269 | A1 * | 8/2006 | Baratta | 125/13.01 |
| 2006/0201492 | A1 * | 9/2006 | Baratta et al. | 125/21 |
| 2007/0113714 | A1 * | 5/2007 | Burke et al. | 83/102.1 |
| 2007/0163412 | A1 * | 7/2007 | Baratta et al. | 83/651 |
| 2007/0277661 | A1 * | 12/2007 | Domeny et al. | 83/477.2 |
| 2008/0022827 | A1 * | 1/2008 | Weir et al. | 83/478 |
| 2008/0081545 | A1 * | 4/2008 | Baratta | 451/451 |
| 2008/0210212 | A1 * | 9/2008 | Baratta | 125/15 |
| 2010/0300258 | A1 * | 12/2010 | Werder et al. | 83/483 |
| 2011/0061506 | A1 * | 3/2011 | Frolov | 83/102.1 |

* cited by examiner

DEVICE FOR ADJUSTING THE BLADE GUARD HOLDER OF A WALL SAW

This claims the benefit of German Patent Application DE 10 2009 026 638.0, filed Jun. 2, 2009 and hereby incorporated by reference herein.

The present invention relates to a device for adjusting the blade guard holder arranged on the saw arm of a wall saw, and it also relates to a blade guard holder with an adjustment device.

BACKGROUND

Wall saws are sawing devices for cutting reinforced or non-reinforced walls, ceilings and floors made of concrete or a similar material using rotating saw blades fitted with cutting segments. They are used in building construction and civil engineering, as well as for restoration and renovation work. For example, in the case of demolition or rebuilding work, it can be necessary to cut or remove already existing concrete walls, or else to cut out parts of such walls.

In order to protect the operator, generally known wall saws have a saw blade guard that surrounds the saw blade and prevents contact from being made. The saw blade guard is mounted on the saw arm via a blade guard holder. The blade guard holder is non-positively affixed via a fastening screw, whereby the fastening screw can only be actuated when the saw blade and the saw blade guard have been dismantled. Consequently, the blade guard holder can only be adjusted relative to the saw arm when the saw blade and the saw blade guard have been dismantled.

The adjustment of a blade guard holder is relatively impractical and rather time-consuming. Saw blades can weigh up to 70 kg and the blade guard can weigh up to 40 kg. Therefore, in order to lift the saw blade guard and the saw blade, the operator has to lift a weight of 100 kg or more.

SUMMARY OF THE INVENTION

It is an object of the present invention to simplify the adjustment of the blade guard holder relative to the saw arm. In particular, it should be possible to adjust the blade guard holder when the saw blade and the saw blade guard are mounted in place.

The present invention provides a coupling element for a device for adjusting the blade guard holder arranged on the saw arm of a wall saw. A first end of the coupling element is joined to the blade guard holder, and, in a locked state, a second end is joined to the saw arm. Since the coupling element is joined to the saw arm, the coupling element is accessible and the blade guard holder can be adjusted when the saw blade and the saw blade guard are mounted in place.

In a preferred embodiment, the coupling element is configured as a toggle lever having a first section, a second section and a third section. Here, the toggle lever is preferably configured as a half-toggle lever system. In a half-toggle lever system, a lever arm is articulated onto a fixed point.

Especially preferably, the first section of the toggle lever has a stop element that, in the locked state, interacts with a stop pin provided on the second section of the toggle lever. Here, the stop element and the stop pin are arranged in such a way that the toggle lever passes the dead center position by a certain value when the stop element is in contact with the stop pin. Since the dead center position is passed, an accidental loosening of the blade guard holder is ruled out.

In a preferred embodiment, the third section of the toggle lever is configured as a pin that, in the locked state, is positively joined to a bore in a gearwheel of the saw arm. The gearwheel has several bores that correspond to certain positions of the blade guard holder relative to the saw arm. As an alternative, in the locked state, the third section of the toggle lever can interact with a spline gear.

The coupling element can preferably be moved from a locked state into an unlocked state by means of an operating element. The operating element can be configured, for example, as a hexagon that is actuated by means of a fork wrench. As an alternative, the operating element can be configured as a lever that is actuated manually by the operator.

The coupling element preferably has a setting mechanism for setting the play between the coupling element and the saw arm. By setting the play, a positive connection can be ensured so that the occurring forces are accommodated.

In the locked state, the coupling element is preferably arranged in such a way that the dead center position of the coupling element is passed. Since the dead center position is passed, an accidental loosening of the blade guard holder is ruled out.

According to another aspect, a blade guard holder is provided with an adjustment device according to the invention. The blade guard holder preferably has a guide sleeve. The guide sleeve allows a controlled movement of the toggle lever during the locking and unlocking, and it serves to accommodate the forces that occur.

Additional advantages and advantageous embodiments of the subject matter of the invention can be gleaned from the description, the drawing and the claims. By the same token, the features according to the invention that are mentioned above as well as below can each be used individually or together in any desired combination. The embodiments shown and described are not to be understood as a complete listing but rather they have the character of examples describing the invention.

BRIEF DESCRIPTION OF THE DRAWINGS

The following is shown.

DETAILED DESCRIPTION

Figure 1:
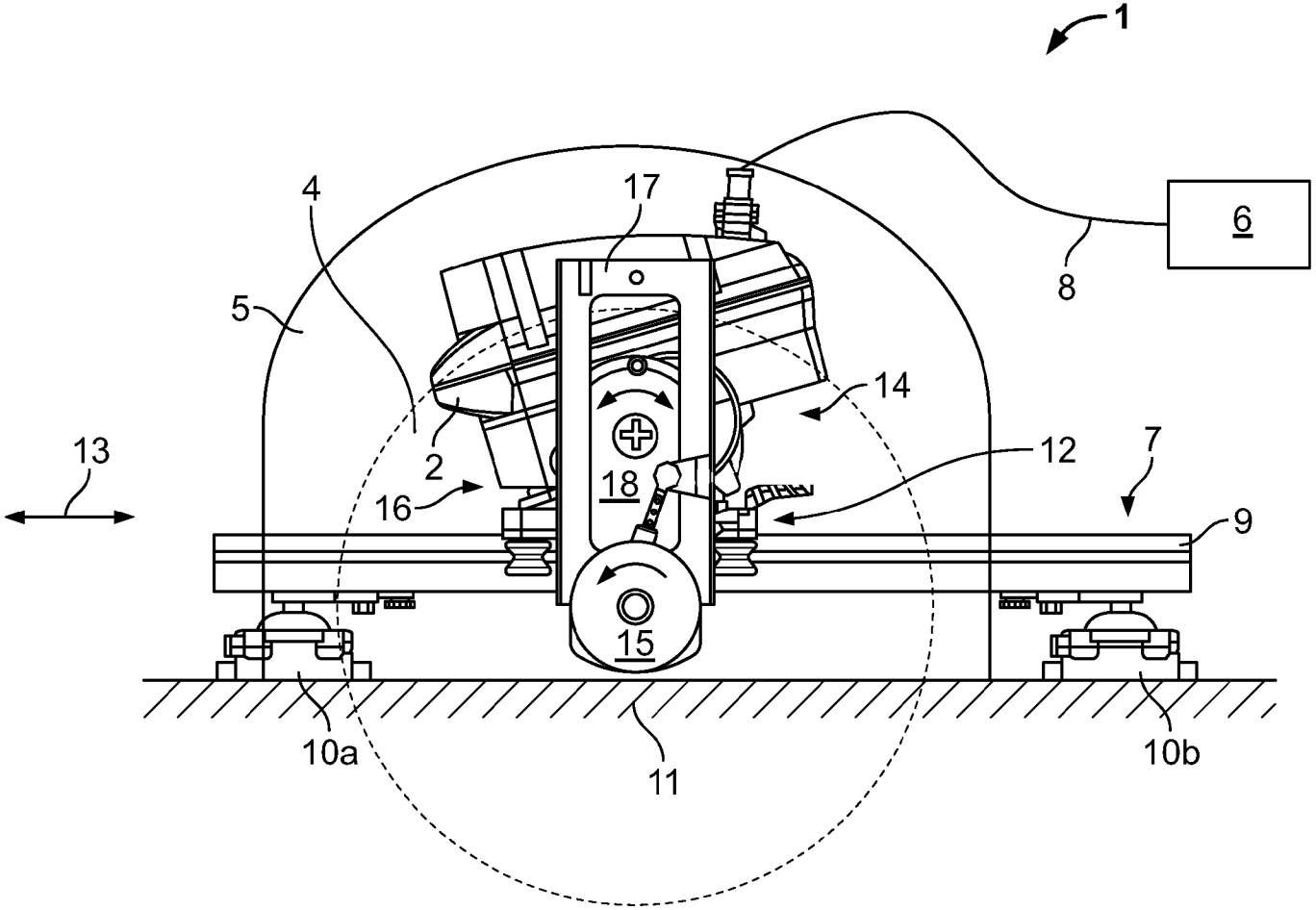
FIG. 1—a wall saw with a holder for a saw blade guard.

Unless otherwise indicated, identical or functionally equivalent elements are designated by the same reference numerals.

The wall saw 1 according to the invention shown in FIG. 1 comprises a saw head 2, a saw arm 3 with a saw blade 4 and a saw blade guard 5, an operating mechanism 6 and an attachment device 7 for attaching the wall saw 1. The wall saw 1 is operated by means of the operating mechanism 6 that is joined to the saw head 2 via a supply line 8. The wall saw 1 is attached to the attachment device 7, which consists of a guide rail 9 and rail feet 10*a*, 10*b* on the floor 11.

The saw head 2 is arranged so as to be moveable lengthwise over a guide carriage 12 on the guide rail 9 in the direction of an axis 13. The saw head 2 comprises a first drive mechanism 14 for rotating the saw blade 4 around an axis of rotation 15, and a second drive mechanism 16 for controlling the advance of the guide carriage 12 along the guide rail 9 in the direction of the axis 13. The first drive mechanism 14 drives a drive shaft whose rotational movement is transmitted to a drive shaft by means of a gear device arranged in the saw arm 3 (see FIG. 2), said drive shaft driving the saw blade 4 around the rotational axis 15. As an alternative, the drive mechanisms for rotating the saw blade 4 and for controlling the advance of the guide carriage 12 can be configured as a shared drive mechanism.

In order to protect the operator, the wall saw 1 has a saw blade guard 5 that surrounds the saw blade 4 and is arranged on the saw arm 3 by means of a blade guard holder 17. The saw arm 3 is configured so as to pivot around a rotational axis 18.

Figure 2:
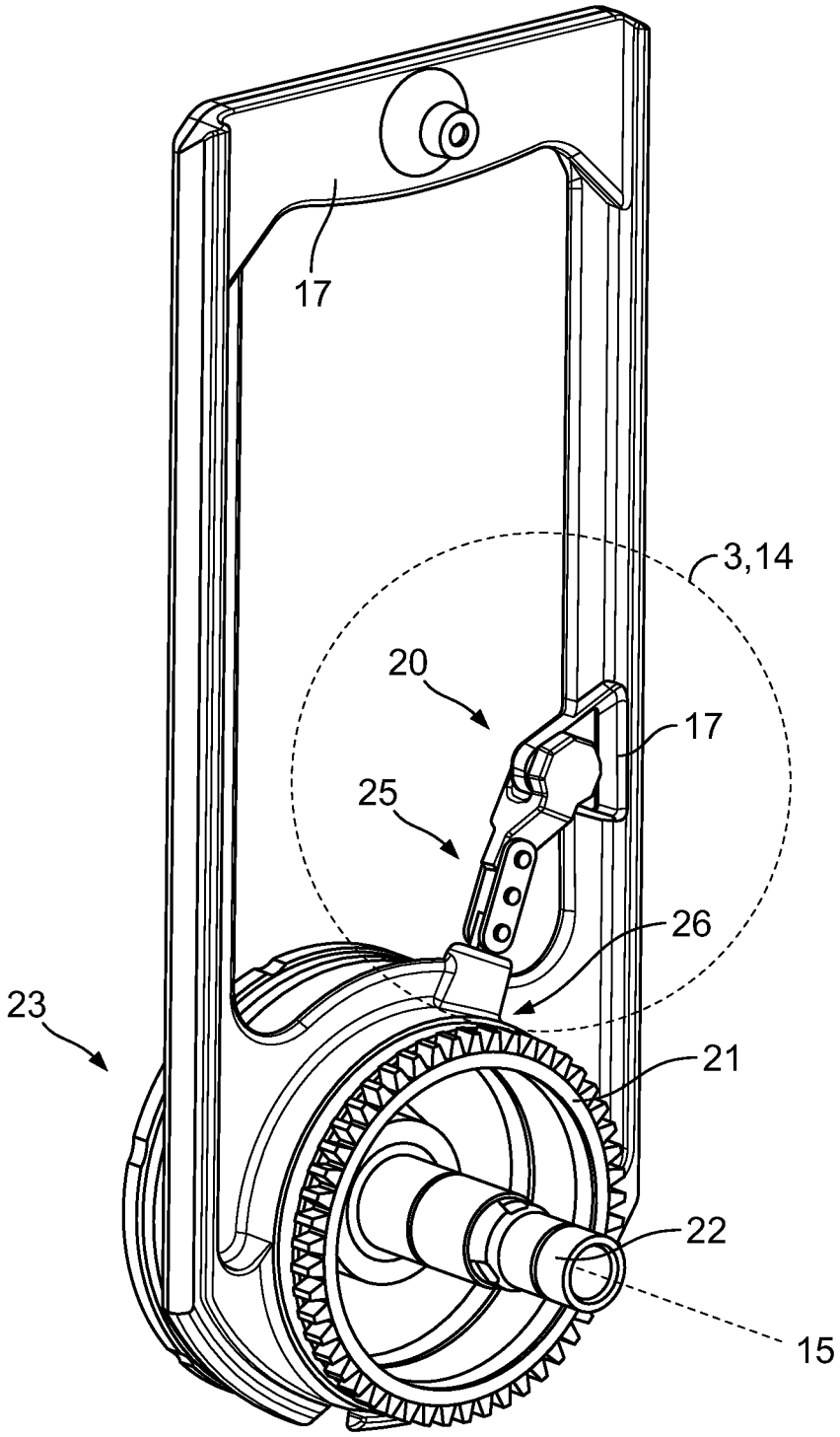
FIG. 2—a blade guard holder according to the invention with a device for adjusting the blade guard holder.

FIG. 2 shows the blade guard holder 17 of FIG. 1 with a device 20 according to the invention for adjusting the blade guard holder 17 in a view of the blade guard holder 17 facing away from the saw blade 4.

The saw blade 4 is driven around the rotational axis 15 by means of the drive mechanism 14. The rotational movement of the drive mechanism 14 is transmitted to a drive shaft 22 by means of a gear in the form of a gearwheel 21. The gearwheel 21 is part of the saw arm 3. The drive shaft 22 is configured so as to rotate around the rotational axis 15. On the end of the drive shaft 22 facing the mounted saw blade 4, a receiving flange 23 is provided to receive the saw blade 4.

The blade guard holder 17 is attached to the saw arm 3 by means of the adjustment device 20 according to the invention. The adjustment device 20 comprises a coupling element 25 configured as a toggle lever that, at a first end, is supported on the blade guard holder 17 in a fixed point and, at a second end, engages with a first bore 26 in the gearwheel 21.

Figure 3B:
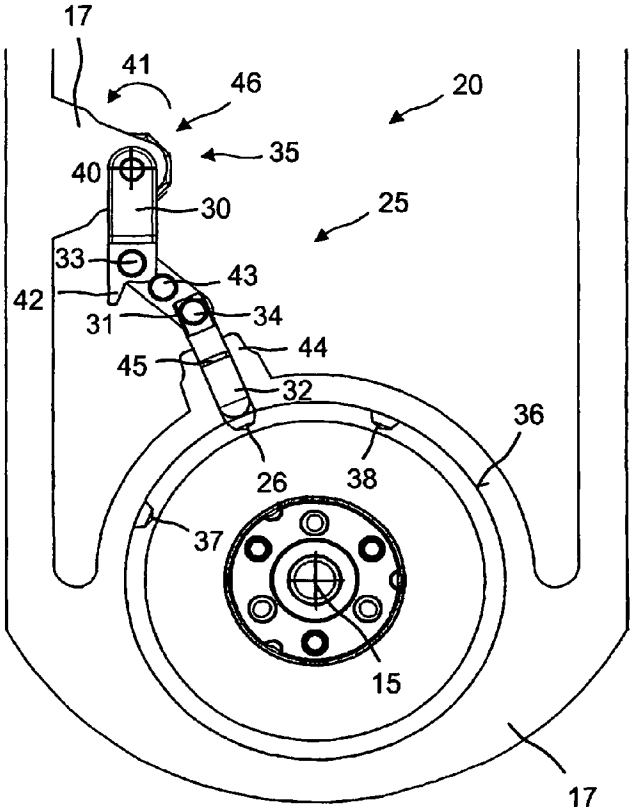
FIG. 3*a,b*—the adjustment device according to the invention for the blade guard holder of FIG. 2 in a view facing away from the saw blade, in the locked state (FIG. 3*a*) and in the unlocked state (FIG. 3*b*).
Figure 3A:
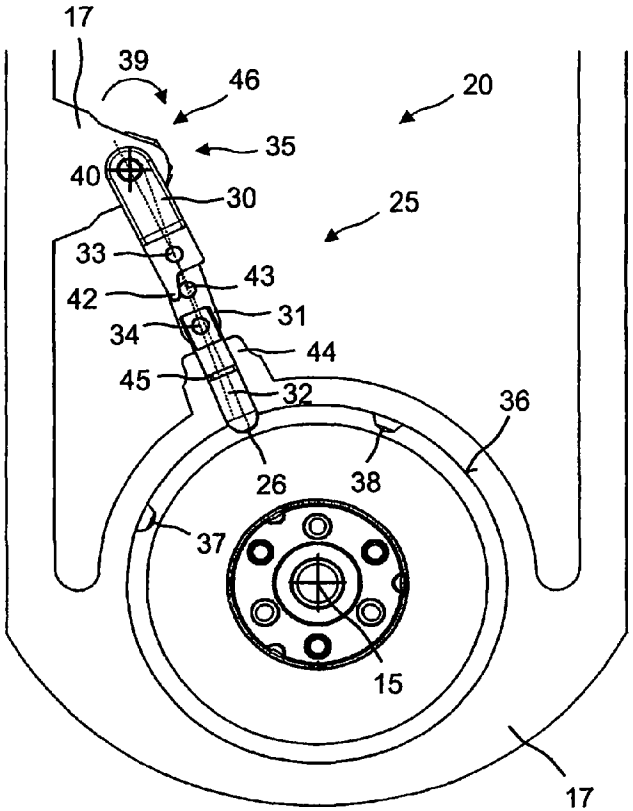

FIG. 3*a,b* show a section of the blade guard holder 17 of FIG. 2 with the adjustment device 20 according to the invention in a front view of the blade guard holder 17 facing the saw blade 4. FIG. 3*a* shows the locked state while FIG. 3*b* shows the unlocked state of the adjustment device 20 for the blade guard holder 17.

The coupling element 25 is configured as a toggle lever having a first section 30, a second section 31 and a third section 32. The first and second sections 30, 31 of the toggle lever 25 are adjustably coupled via a first articulation 33, while the second and third sections 31, 32 are adjustably coupled via a second articulation 34.

In the locked state, the first section 30 of the toggle lever 25 is joined to the blade guard holder 17 by means of an operating element 35. The operating element 35 is configured as a hexagon that is actuated via a fork wrench. As an alternative, the operating element 35 can be configured as a lever that is actuated manually by the operator.

The third section 32 of the toggle lever 25 is configured in the form of a pin and engages in the first bore 26, which is arranged in a radial surface 36 of the gearwheel 21. In the radial surface 36 next to the first bore 26, the gearwheel 21 has a second bore 37 and a third bore 38 into which the pins 32 of the toggle lever 25 can engage. In the embodiment of FIG. 3*a*, the pin 32 is engaged with the first bore 26, which corresponds to a 0° position of the blade guard holder 17. The second and third bores 37, 38 correspond, for example, to a +45° position and a −45° position of the blade guard holder 17 relative to the saw arm 3. In the radial surface 36 of the gearwheel 21, additional bores can be provided that correspond to defined positions of the blade guard holder 17 relative to the saw arm 3.

In order to adjust the blade guard holder 17 relative to the saw arm 3, the toggle lever 25 is unlocked. For this purpose, the operating element 35 is moved in the direction indicated by the arrow 39 around the rotational axis 40, which runs perpendicular to the plane of the drawing. As a result, the toggle lever 25 is released and the first section 30 of the toggle lever 25 moves into the position shown in FIG. 3*b*. The toggle lever buckles and pulls the pin 32 out of the first bore 26 of the gearwheel 21. The blade guard holder 17 can pivot around the rotational axis 15 and can now be pivoted into the desired position. As soon as the pin 32 of the toggle lever 25 is in the desired position, the toggle lever 25 is closed by the rotation of the operating element 35 in the direction indicated by the arrow 41, and the pin 32 engages with the bore in the gearwheel 21.

An end of the first section 30 of the toggle lever 25 facing the second section 31 has a stop element 42 in the form of a stop finger. The stop finger 42 interacts with a stop pin 43 of the second section 31. In the locked state, the stop finger 42 is in contact with the stop pin 43 and any further rotation of the first section 30 in the direction 41 is blocked by the stop pin 43. The stop element 42 and the stop pin 43 are arranged in such a way that the toggle lever 25 has passed the dead center position by a certain value when the stop element 42 is in contact with the stop pin 43. Since the dead center position is passed, an accidental loosening of the blade guard holder 17 due to an inadequate tightening of a fastening screw is ruled out in the adjustment device 20 according to the invention. The passing of the dead center position is referred to as self-locking or self-holding. The self-locking in the locked state prevents the toggle lever 25 from being opened by the operators.

The blade guard holder 17 has a guide sleeve 44 that guides the pin 32 of the toggle lever 25. The guide sleeve 44 allows a controlled movement of the pin 32 during the locking and unlocking of the toggle lever 25, and it serves to accommodate the occurring forces. For protection against dust or other external influences, the pin 32 has a sealing element 45.

The toggle lever 25 has a setting mechanism in the form of a cam for setting the play between the pin 32 and the bore. Using the setting mechanism 46, the play or the pre-tensioning of the toggle lever 25 is set in such a way that, in the locked state, the pin 32 fits positively into the bore 26, 37, 38 and, in the unlocked state, said pin 32 slides out of the bore 26, 37, 38, so that the blade guard holder 17 can be moved into the desired position.

In the embodiment shown in FIG. 3*a,b*, the blade guard holder 17 is joined positively to the saw arm 3 via the pin 32 that engages into a bore 26, 37, 28 in the gearwheel 21. As an alternative, the radial surface 36 of the gearwheel 21 can be provided with teeth into which the third section 32 of the toggle lever 25 engages. Such an embodiment offers the advantage that the blade guard holder 17 is almost continuously adjustable relative to the saw arm 3.

What is claimed is:

1. A wall saw comprising:

a saw arm having a gear mechanism for rotating a saw blade around a rotational axis;

a blade guard surrounding the saw blade;

a blade guard holder for mounting the blade guard on the saw arm, the blade guard being removable from the blade guard holder and the blade guard holder being rotatably mounted on the saw arm around the rotational axis of the saw blade; and an adjuster for adjusting the position of the blade guard holder relative to the saw arm, the adjuster having an operating element and a coupling element with a first end and a second end, the first end of the coupling element being joined to the blade guard holder, and, the second end being fixable to the saw arm, the coupling element being adjustable via the operating element between a locked state and an unlocked state, in the locked state, the second end of the coupling element being fixed to the saw arm and fixing the blade guard holder nonrotatably to the saw arm, and, in the unlocked state, the second end of the coupling element being releasable from the saw arm and permitting the blade guard holder to rotate relative to the saw arm around the rotational axis of the saw blade;

wherein the coupling element includes a toggle lever having a first section having the first end of the coupling element, a second section and a third section having the second end of the coupling element;

the first section being rotatably coupled to the blade guard holder at a pivot point and being adjustable around the pivot point via the operating element;

the second section being rotatably coupled to the first section via a first pivot joint; and the third section being rotatably coupled to the second section via a second pivot joint and being adjustable between the locked state and the unlocked state, in the locked state, the third section being fixed to the saw arm, and, in the unlocked state, the third section being released from the saw arm.

2. The wall saw as recited in claim 1 wherein the first section has a stop element that, in the locked state, interacts with a stop pin provided on the second section.

3. The wall saw as recited in claim 2 wherein the third section of the toggle lever is configured as a pin that, in the locked state, is positively joined to a bore in a gearwheel of the saw arm.

4. The wall saw as recited in claim 1 wherein the third section of the toggle lever is configured as a pin that, in the locked state, is positively joined to a bore in a gearwheel of the saw arm.

5. The wall saw as recited in claim 4 wherein the gearwheel has several bores corresponding to certain positions of the blade guard holder relative to the saw arm.

6. The wall saw as recited in claim 1 wherein the coupling element has a setting mechanism for setting play between the coupling element and the saw arm.

7. The wall saw as recited in claim 1 wherein in the locked state, the coupling element is arranged in such a way that a dead center position of the coupling element is passed.

8. The wall saw as recited in claim 7 further comprising a guide sleeve.

9. The wall saw as recited in claim 1 further comprising a saw head with a first drive for rotating the saw blade around an axis of rotation.

10. The wall saw as recited in claim 9 further comprising a guide carriage supporting the saw head, and a second drive controlling advance of the guide carriage.

11. The wall saw as recited in claim 10 further comprising an attachment device including a guide rail, the guide carriage moving on the guide rail.

12. ; The wall saw as recited in claim 11 wherein the attachment device includes two rail feet for attachment to a wall.

13. A device for adjusting a blade guard holder arranged on a saw arm of a wall saw, the device comprising:

a coupling element having a first end and a second end, the first end of the coupling element being joined to a blade guard holder, and, in a locked state, the second end is joined to a saw arm, the coupling element including a toggle lever having a first section, a second section and a third section, wherein the first section has a stop element that, in the locked state, interacts with a stop pin provided on the second section, and wherein the third section of the toggle lever is configured as a pin that, in the locked state, is positively joined to a bore in a gearwheel of the saw arm.

14. A device for adjusting a blade guard holder arranged on a saw arm of a wall saw, the device comprising:

a coupling element having a first end and a second end, the first end of the coupling element being joined to a blade guard holder, and, in a locked state, the second end is joined to a saw arm, the coupling element including a toggle lever having a first section, a second section and a third section, wherein the third section of the toggle lever is configured as a pin that, in the locked state, is positively joined to a bore in a gearwheel of the saw arm.

15. The device as recited in claim 14 wherein the gearwheel has several bores corresponding to certain positions of the blade guard holder relative to the saw arm.

* * * * *